US010074450B2

(12) United States Patent
Långström et al.

(10) Patent No.: US 10,074,450 B2
(45) Date of Patent: Sep. 11, 2018

(54) SYSTEM FOR CONTROLLING ENVIRONMENT IN A REACTION BOX

(71) Applicant: Bencar AB, Uppsala (SE)

(72) Inventors: Bengt Långström, Uppsala (SE); Carl-Olof Sjöberg, Upplands Väsby (SE)

(73) Assignee: P M B, SAS, Peynier (FR)

( * ) Notice: Subject to any disclaimer, the term of this patent is extended or adjusted under 35 U.S.C. 154(b) by 595 days.

(21) Appl. No.: 14/370,572

(22) PCT Filed: Dec. 19, 2012

(86) PCT No.: PCT/SE2012/051425

§ 371 (c)(1),
(2) Date: Jul. 3, 2014

(87) PCT Pub. No.: WO2013/103312

PCT Pub. Date: Jul. 11, 2013

(65) Prior Publication Data

US 2015/0004060 A1 Jan. 1, 2015

(30) Foreign Application Priority Data

Jan. 5, 2012 (SE) ..... 1250005

(51) Int. Cl.
*G21F 7/015* (2006.01)

(52) U.S. Cl.
CPC ..... *G21F 7/015* (2013.01)

(58) Field of Classification Search
CPC ..... G21F 7/015
See application file for complete search history.

(56) References Cited

U.S. PATENT DOCUMENTS 5,368,633 A * 11/1994 Foldyna ..... G21F 9/02 376/314
5,843,239 A * 12/1998 Shrotriya ..... B08B 7/0035 134/1.1

(Continued)

FOREIGN PATENT DOCUMENTS

CN 101723513 A 6/2010
EP 0299249 A1 1/1989

(Continued)

OTHER PUBLICATIONS

European Search Report dated Jul. 20, 2015 from corresponding European Application No. 12864425.9.

*Primary Examiner* — Lisa Caputo
*Assistant Examiner* — Punam Roy
(74) *Attorney, Agent, or Firm* — Porter Wright Morris & Arthur LLP

(57) ABSTRACT

A system (100) for controlling the environment in a reaction box (300) comprises a controller (150) configured to control a gas multiplexer (130) to switch between applying an under pressure in the reaction box (300) from a vacuum pump (140) and applying a gas flow from a connected gas source (200) to the reaction box (300) multiple times in a cyclic manner. A particle monitor (160) generates particle information representing a concentration of particles in the reaction box (300). This particle information is stored as a GMP clean room classification notification for the reaction box (300).

22 Claims, 6 Drawing Sheets

(56) References Cited

U.S. PATENT DOCUMENTS

| | | | | |
|---|---|---|---|---|
| 5,849,092 | A * | 12/1998 | Xi | C23C 16/4405 134/1.1 |
| 6,003,526 | A | 12/1999 | Lo et al. | |
| 6,045,618 | A * | 4/2000 | Raoux | B01D 45/06 118/715 |
| 6,863,019 | B2 * | 3/2005 | Shamouilian | B08B 7/00 118/715 |
| 7,019,829 | B2 * | 3/2006 | Powell | G01J 3/02 356/316 |
| 7,829,032 | B2 | 11/2010 | Van Dam et al. | |
| 8,118,946 | B2 * | 2/2012 | Lau | B08B 7/00 134/1 |
| 2006/0108221 | A1 * | 5/2006 | Goodwin | G01N 33/0009 204/424 |
| 2006/0234621 | A1 * | 10/2006 | Desrochers | F24F 3/044 454/239 |
| 2006/0245980 | A1 | 11/2006 | Kiselev et al. | |
| 2007/0082601 | A1 * | 4/2007 | Desrochers | F24F 3/044 454/256 |
| 2008/0035542 | A1 | 2/2008 | Mourtada et al. | |
| 2008/0092806 | A1 * | 4/2008 | West | B08B 1/00 118/70 |
| 2011/0008215 | A1 | 1/2011 | Elizarov et al. | |
| 2011/0150714 | A1 | 6/2011 | Elizarov et al. | |
| 2012/0090382 | A1 * | 4/2012 | Favre | G01N 33/0018 73/31.06 |

FOREIGN PATENT DOCUMENTS

| | | | |
|---|---|---|---|
| WO | 99/63546 | A2 | 12/1999 |
| WO | 2009/138072 | A1 | 11/2009 |

* cited by examiner

SYSTEM FOR CONTROLLING ENVIRONMENT IN A REACTION BOX

TECHNICAL FIELD

The embodiments generally relate to a system for controlling reaction boxes, and in particular to such a system for controlling the environment in the reaction boxes.

BACKGROUND

Today radioactive tracers, so called radiotracers, for single-photon emission computed tomography (SPECT) and positron emission tomography (PET), and radiopharmaceuticals for therapeutic uses are produced in hot laboratories or special production facilities, which are run under regulatory rules in order to meet good manufacturing practice (GMP) production criteria. The hot laboratories are large facilities, generally divided into separate sections and working compartments, mostly denoted hot cells, with room for operators, laboratories with radiation-shielding and storehouse for radioactive waste.

The hot cells in the hot laboratories are chambers with strong radiation shielding of high-density materials. The interior surfaces of the hot cells are typically lined with stainless steel coated by oil paints or polyethylene films to facilitate decontamination.

A hot laboratory is typically part of a radiochemical laboratory complex, requiring extensive planning to house the extensive facility. High demands are also put on the staff working in the hot laboratory with significant documentation in order to meet, among others, the regulatory demands on ventilation classification, radiation safety and measurements of biologics, all with the emphasis on the safety for personal and the production of the radiotracers and the radiopharmaceuticals for the patients within the facilities Today qualification of hot laboratories according to GMP is typically made by independent companies or regulatory bodies to test and qualify the protocols and documentation of the hot laboratories. All important information is then documented in standard operation procedure (SOP) for the hot laboratories as well as for the production of the various labeled products. Such qualifications are generally performed two to three times per year.

It is obvious that building and running hot laboratories is very expensive and requires significant amount of regulatory documentation and control, which thereby put limitations to which medical facilities that have access to radiotracers and other radioactively labeled substances for diagnosis or therapy. Furthermore, the need for separate hot laboratories limits the type of radioactive isotopes (radionuclides) that can be used in the radiotracers and labeled substances to have a half-life that is long enough to allow transport of the radiotracers or labeled substances from the hot laboratories to the PET/SPECT or treatment center and still have sufficient radioactivity for efficient diagnosis or treatment of a patient. This means that in practical applications fluorine-18 ($^{18}F$) with a half-life of about 110 minutes is commonly used as radionuclide. However, there is a general need to be able to use other radioisotopes with a much shorter half-life, such as $^{11}C$, $^{13}N$ or $^{15}O$ with half-life of about 20, 13 and 2 minutes, respectively. These radionuclides, however, need on-site production facilities.

Thus, there is a need for a system that can be used to manufacture radiotracers and other radioactive substances in a safe and cost-effective manner. It is a further need that such a system is miniaturized so that it can be arranged in or close to the PET/SPECT or treatment center to enable usage of radioisotopes with relatively short half-lives. These needs are also present for the manufacture of other, non-radioactive, substances, in particular for various diagnostic and therapeutic substances.

U.S. Pat. No. 7,829,032 discloses a microfluidic device that can be used in a fully automated synthesis system of radioactive compounds for PET-imaging in a fast, efficient and compact manner. The system is in the form of an automated, stand-alone, microfluidic instrument for a multi-step chemical synthesis of radiopharmaceuticals.

US 2011/0008215 discloses a system for a fully automated synthesis of radioactive compounds for PET-imaging in an efficient, compact and safe-to-the-operator manner. The system comprises a hot component unit and a cold component unit provided as separate units that are operatively connected to each other.

The systems disclosed in the above two patent documents enable miniaturization of the synthesis of radiotracers and other radioactively labeled substances. However, the prior art systems are not designed to meet the high demands of GMP in the synthesis process.

SUMMARY

It is a general objective to provide a system for controlling environment in a reaction box.

It is a particular objective to provide a system capable of producing and verifying GMP clean room environment in a reaction box.

These and other objectives are met by embodiments disclosed herein.

An aspect of the embodiments defines a system for controlling the environment in a reaction box. The system comprises a gas inlet connector connectable to at least one gas source comprising a respective gas and a gas outlet connector connectable to at least one reaction box. A gas multiplexer is connected to the gas inlet connector and the gas outlet connector and is configured to interconnect a gas flow from the gas inlet connector to the gas outlet connector. A vacuum pump is connected to the gas multiplexer and is configured to generate an under pressure inside a reaction box when the gas multiplexer interconnects the vacuum pump with the gas outlet connector. A controller controls the gas multiplexer to switch between applying an under pressure in a reaction box and applying a gas flow from a gas source to the reaction box multiple times in a cyclic manner to reduce the amount of particles present in the reaction box. The controller is also configured to control a particle monitor to generate particle information representing a concentration of particles present in the reaction box following an end of the cyclic switching between applying the under pressure and applying the gas flow. The particle information is stored in a memory of the system as a good manufacturing practice clean room classification notification for the reaction box.

BRIEF DESCRIPTION OF THE DRAWINGS

The invention, together with further objects and advantages thereof, may best be understood by making reference to the following description taken together with the accompanying drawings, in which.

DETAILED DESCRIPTION

Throughout the drawings, the same reference numbers are used for similar or corresponding elements.

The embodiments generally relate to a system for controlling reaction boxes, and in particular such a system that is used for controlling the environment in the reaction boxes and logging information of the controlled environment.

The system of the embodiments can be used to control miniaturized reaction boxes in which various synthesis steps and other reactions can take place. The system is advantageously used in combination with synthesis of various radiotracers useful in diagnosis, such as in SPECT or PET systems, or in therapeutic applications. Also other substances and molecules lacking radionucleotides could be produced in the reaction boxes controlled by the system of the embodiments.

The reaction boxes controlled by the system could, in a simplified approach, be regarded as downscaled versions of traditional hot laboratories and production facilities. However, the reaction boxes are designed to be sufficiently small to be arranged at various desired sites in healthcare facilities, such as in SPECT/PET centers or in therapeutic centers. In fact, the small size of the reaction boxes and the system enables arrangement even in or in direct connection with the particular diagnostic or treatment room where the actual diagnosis or treatment is to take place of a patient. Thus, the size of each reaction box is typically in the range of centimeters or decimeters. For instance, each side of the reaction box could be in the range of about 5 cm up to about 50 cm as non-limiting but illustrative examples. Hence, it is in fact possible to organize several reaction boxes together controlled by a single system and still the arrangement will only occupy a very limited space.

Figure 1:
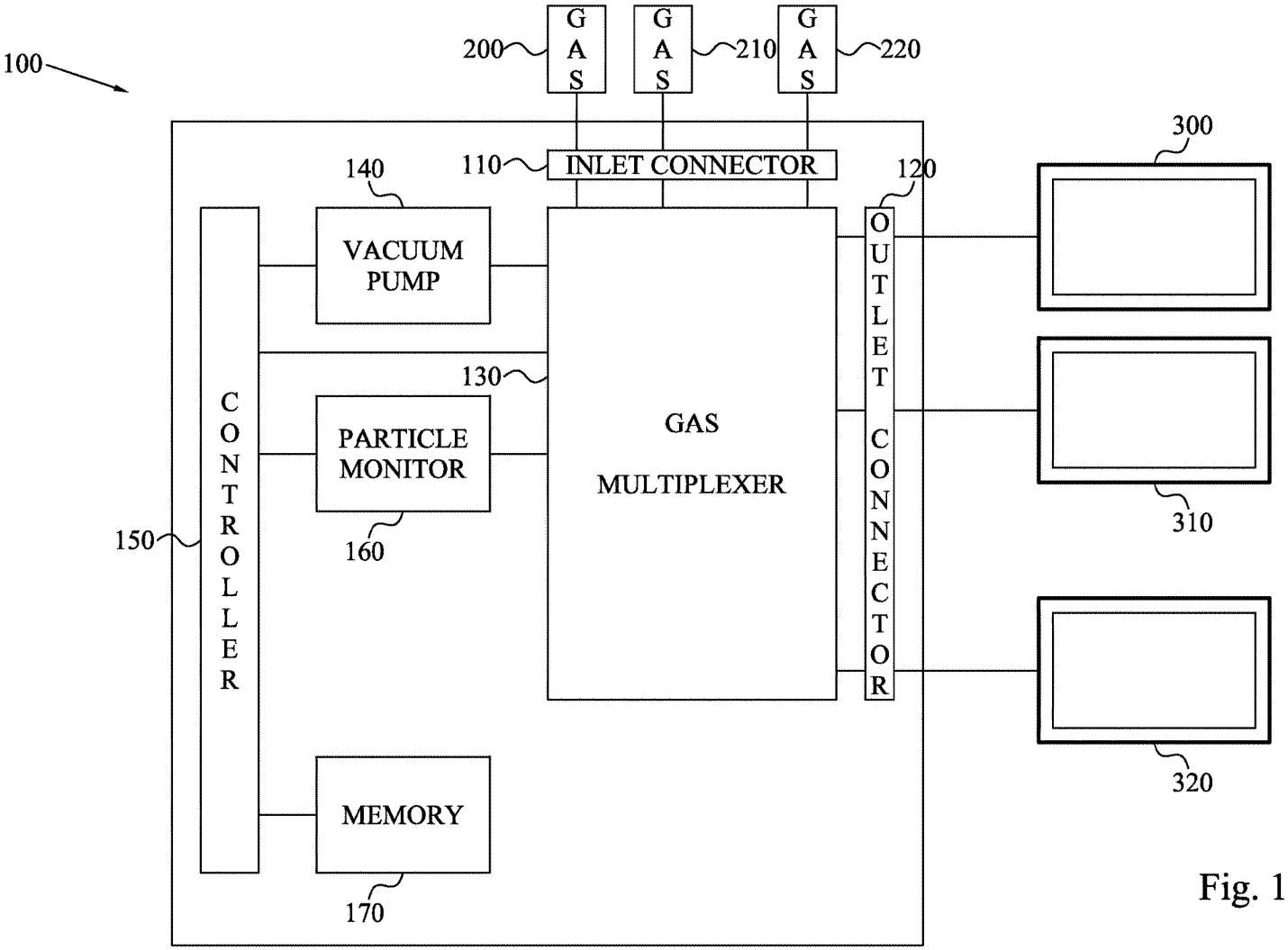
FIG. 1 is a schematic illustration of a system for controlling environment in a reaction box according to an embodiment.

FIG. 1 is a schematic block diagram of a system 100 for controlling environment in a reaction box 300, 310, 320. The system 100 comprises a gas inlet connector 110 having connector terminal(s) connectable to a respective gas source 200, 210, 220 comprising a respective, typically pressurized, gas or gas mixture. The gas inlet connector 110 could be connected to a single such gas source 200, 210, 220 thereby only requiring a single connector terminal that is configured to be connected to the gas source 200, 210, 220 to form a gas connection between the gas source 200, 210, 220 and the gas inlet connector 110. However, it might be preferred to be able to change the gas environment inside a reaction box 300, 310, 320 prior to, during or following synthesis. Alternatively, or in addition, the system 100 could be connected to multiple reaction boxes 300, 310, 320 requiring different gas environments for the respective syntheses to take place in the reaction boxes 300, 310, 320. In such cases, the system 100 and the gas inlet connector 110 preferably comprise multiple, i.e. at least two, connector terminals to be connected to multiple gas sources 200, 210, 220 as shown in FIG. 1.

The gas sources 200, 210, 220 could comprise any gas or gas mixture, preferably in pressurized form. Non-limiting examples of such gases or gas mixtures include air, nitrogen ($N_2$), helium (He) and argon (Ar).

The system 100 also comprises a gas outlet connector 120 having connector terminal(s) connectable to the reaction box(es) 300, 310, 320. The gas outlet connector 120 comprises at least one such connector terminal per connected reaction box 300, 310, 320. In an embodiment, a single such connector terminal is used to affect both gas flow into the reaction box 300, 310, 320 but also enable a gas flow out from the reaction box 300, 310, 320 and into the gas outlet connector 120. Alternatively, multiple connector terminals can be arranged in the gas outlet connector 120 per reaction box 300, 310, 320, where at least one connector terminal is used for providing gas connection and gas flow into the reaction box 300, 310, 320 and at least one connector terminal is used for providing gas connection and gas flow out from the reaction box 300, 310, 320.

A gas multiplexer 130 is arranged in the system 100 connected to the gas inlet connector 110 and the gas outlet connector 120. The gas multiplexer 130 is configured to interconnect a gas flow from the gas inlet connector 110 to the gas outlet connector 120. Thus, the gas multiplexer 130 interconnects a connector terminal of the gas inlet connector 110 to a connector terminal of the gas outlet connector 120 to form a gas connection from a gas source 200, 210, 220 to a reaction box 300, 310, 320. This means that gas from the gas source 200, 210, 220 connected to the selected connector terminal in the gas inlet connector 110 will flow through the connector terminal, the gas multiplexer 130 and into the selected connector terminal in the gas outlet connector 120 and thereby reach the reaction box 300, 310, 320 connected to this connector terminal.

The operation of the gas multiplexer 130 is controlled by a controller 150 as is further described herein. Thus, the controller 150 sends control signals to the gas multiplexer 130 to identify which connector terminal in the gas inlet connector 110 that should be interconnected to which connector terminal(s) in the gas outlet connector 120.

The system 100 further comprises a vacuum pump 140 or other device configured to generate an under pressure. The vacuum pump 140 is connected to the gas multiplexer 130 to thereby generate a sucking or under pressure inside a reaction box 300, 310, 320 when the gas multiplexer 130 interconnects the vacuum pump 140 with the gas outlet connector 130 and the connector terminal assigned to the reaction box 300, 310, 320.

The previously mentioned controller 150 is thereby configured to control the operation of the gas multiplexer 130 and in particular control the gas multiplexer 130 to switch between applying an under pressure in a selected reaction box 300 and applying a gas flow from a gas source 200 to the reaction box 300 multiple times in a cyclic manner. Thus, the controller 150 thereby controls the gas multiplexer 130 to first interconnect the reaction box 300 to the vacuum pump 140 to apply an under pressure in the reaction box 300 and thereby vent any gas and particles present in the reaction box 300. Then the gas multiplexer 130 interconnects the reaction box 300 to one of the gas sources 200, 210, 220 to thereby open up a gas flow from the gas source 200 to the reaction box 300. This completes one cycle. The procedure is then repeated at least once more with gas venting followed by filling up with clean, fresh gas.

Optionally, the controller 150 could control the gas multiplexer 130 to interconnect the gas inlet connector 110 to the gas outlet connector 120 to thereby provide gas inside a reaction box 300 before initiating the cycles of switching between applying the under pressure and applying the gas flow.

In a particular embodiment, the controller 150 is configured to control the gas multiplexer 130 to switch between applying the under pressure in the selected reaction box 300 by connecting the reaction box 300 to the vacuum pump 140 and applying a gas overpressure from the selected gas source 200 to the reaction box 300.

The cyclic venting of gas inside the reaction box 300 and filling up with fresh, clean gas is performed by the system 100 in order to reduce the amount of particles present in the reaction box 300. Hence, the system 100 thereby forms a controlled clean room environment in the reaction box 300 by the cyclic venting and filling of gas.

The gas multiplexer 130 can connect the reaction box 300 to the same gas source 200 in each cycle. However, it is also possible to switch gas sources 200, 210, 220 to thereby use a first gas source 200 in one cycle and then use a second, different gas source 210 in another cycle.

The system 100 also comprises a particle monitor 160 that is connectable to the reaction boxes 300, 310, 320. The particle monitor 160 is configured to generate particle information representing a (current) concentration of particles present in a reaction box 300, 310, 320. The controller 150 controls the particle monitor 160 to generate the particle information representing the concentration of particles in the selected reaction box 300 following the end of the cyclic switching between applying the under pressure in the reaction box 300 and applying the gas flow. Thus, at least when the cyclic switching discussed above is completed for a selected reaction box 300 the particle monitor 160 is controlled by the controller 150 to monitor the concentration of particles inside the reaction box 300 and generate or log particle information representing this current concentration of particles.

The particle monitor 160 could be directly connected to the reaction boxes 300, 310, 320 through the gas outlet connector 120. If each reaction box 300, 310, 320 comprises an assigned connector terminal for gas flow into the reaction box 300, 310, 320 and another connector terminal for gas flow out from the reaction box 300, 310, 320, the particle monitor 160 is preferably connected to at least the connector terminal for the gas flow out from the reaction box 300, 310, 320.

In another embodiment, the particle monitor 160 is connected to the gas multiplexer 130. When the particle monitor 160 is to monitor the particle concentration and generate the particle information, the controller 150 controls the gas multiplexer 130 to interconnect the particle monitor 160 to the gas outlet connector 120 and the connector terminal therein that is connectable to the reaction box 300.

The embodiments can be used in connection with any suitable particle monitor 160 available in the art. Non-limiting examples of such a particle monitor that can be used are the airborne particle counters marketed by Lighthouse Worldwide solutions, such as Remote 3104, 5104 or indeed any other such airborne particle counter available from Lighthouse Worldwide Solutions or any other company.

The generated particle information from the particle monitor 160 is stored in a memory 170 of the system 100. There the particle information forms part of a good manufacturing practice (GMP) clean room classification notification or information for the particular reaction box 300. The memory 170 preferably stores the GMP clean room classification notification comprising the particle information together with an identifier of the particle reaction box 300 for which the particle information has been generated. This is particularly preferred if the system 100 is connected to and configured to control the environment in multiple reaction boxes 300, 310, 320.

The GMP clean room classification notification constitutes a verification that a desired environment in terms of a sufficient low concentration of particles is present in the reaction box 300 when a synthesis is to be started. Thus, the system 100 thereby verifies that clean room level has been reached in the reaction box 300 prior to synthesis of the desired radiotracer or other substance in the reaction box 300.

This is a significant advantage as compared to the prior art hot laboratories and synthesis facilities where no such clean room verification is feasible in connection with each separate synthesis procedure. In clear contrast, such a clean room verification is only practically possible two to three times per year. It is then assumed that the clean room level is maintained between these two or three verification occasions, although no guarantee exist that the clean room level is indeed maintained and there is no possibility to verify or document this.

The system 100 of the embodiments in clear contrast controls the environment in the reaction boxes 300, 310, 320 through the cyclic switching between applying gas under pressure and gas overpressure to remove most of the particles present in the reaction boxes 300, 310, 320 prior to the start of a synthesis process. The system 100 also generates and logs information describing the clean room standard achieved after the cyclic switching between applying gas under pressure and gas overpressure. This means that GMP clean room classification defining the correct and current concentration of particles in a reaction box 300 immediately prior to the start of the synthesis process is generated and stored in the memory 170. The GMP clean room classification notification can therefore then be used as verification that a correct environment was indeed achieved for the synthesis process.

In an embodiment, the system 100 is configured to control the environment in multiple reaction boxes 300, 310, 320 at least partly in parallel. Thus, the controller 150 could control the gas multiplexer 130 to interconnect one of the reaction boxes 300 to a gas source 200 to provide clean gas in the reaction box 300 simultaneously as the gas multiplexer 130 interconnects another reaction box 310 to the vacuum pump 140 to empty the reaction box 310. Thus, the cyclic switching between applying gas under pressure and gas overpressure can be synchronized to be run in parallel for multiple reaction boxes 300, 310, 320 thereby reducing the total time until the reaction boxes 300, 310, 320 have achieved GMP clean room environment and synthesis can be started.

Alternatively, the system 100 processes the different reaction boxes 300, 310, 320 in series to thereby first achieve clean room environment in a first reaction box 300 prior to processing the next reaction box 310.

Figure 6:
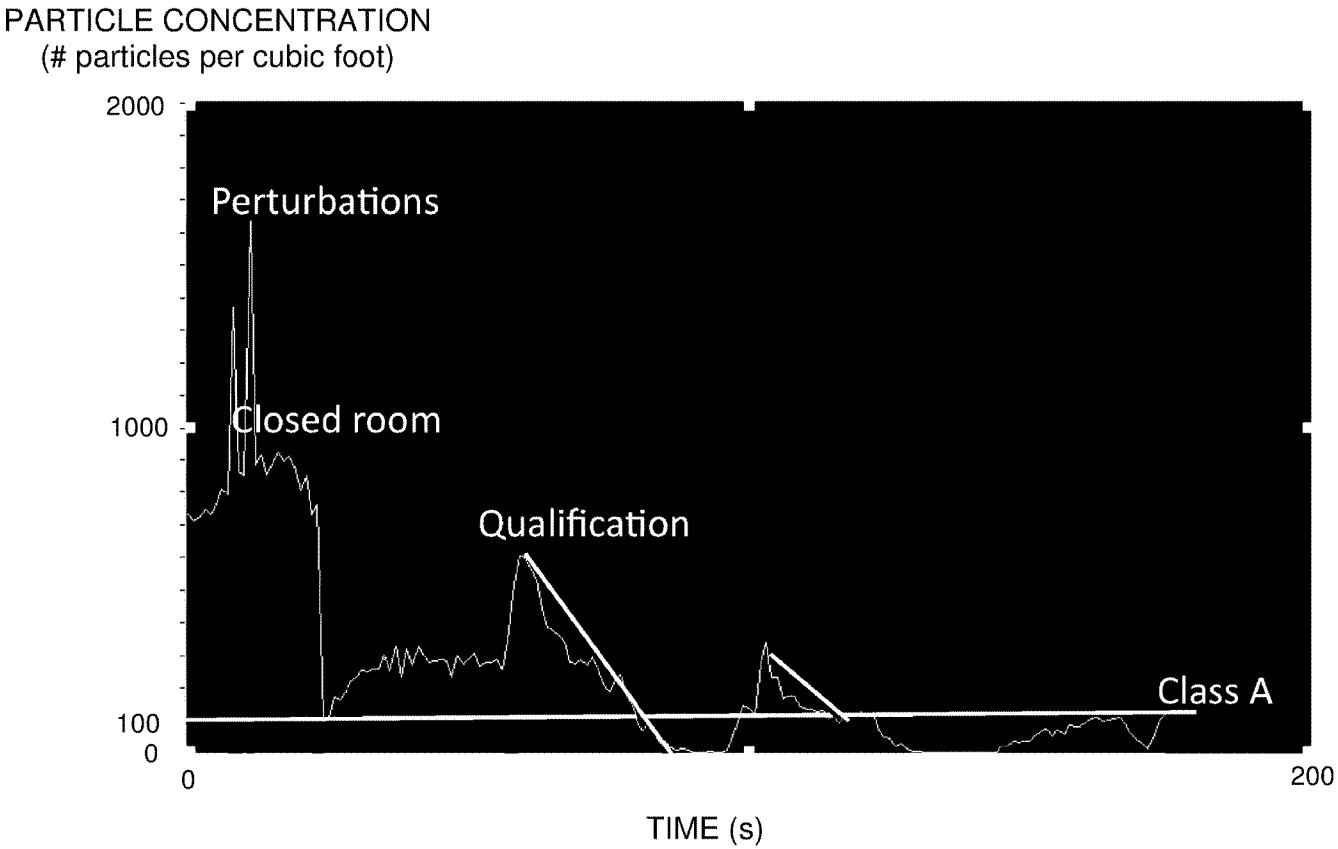
FIG. 6 is a diagram illustrating particle concentration in a reaction box controlled by a system for controlling environment in a reaction box according to an embodiment.

Experiments have been conducted with the system 100 as illustrated in FIG. 1 with regard to the number of particles per cubic foot in a reaction box 300 prior to, during and following a cyclic switching between applying gas under pressure and gas overpressure to the reaction box 300. These results are illustrated in FIG. 6. The initial perturbations shown in FIG. 6 is when a door of the reaction box 300 is opened thereby having gas contact to ambient air in the reaction box 300. The door is then closed to form a closed room in the reaction box 300 as indicated in FIG. 6. Thereafter the system 100 applies an under pressure by interconnecting the reaction box 300 to the vacuum pump 140 to remove gas from the reaction box 300. The concentration of particles present in the reaction box 300 thereby drops significantly. Thereafter clean gas from a gas source 200 is allowed to enter the reaction box 300 causing an increase in particle concentration. After the second cycle of removing and filling gas in the reaction box 300 the particle concentration has reduced significantly as compared to after the first cycle. After a third cycle a stable class A clean room environment has been reached, i.e. maximum 100 particles of diameter ≥5 μm per cubic foot (equivalent to maximum 3,500 particles/$m^3$) and no particles with a diameter ≥5 μm.

Thus, the system 100 is typically able to reach a desired clean room environment in a reaction box 300 already after 2-5 cycles, preferably 3-5 cycles. Hence, a clean room environment is quickly reached by the system 100 only requiring about one or a few minutes.

In an embodiment, the controller 150 is configured to control the gas multiplexer 130 to perform the cyclic switching a predefined number of times for each reaction box 300, 310, 320. This approach is possible by testing on average how many cycles are required in order to reach the desired clean room environment for a certain type of reaction box 300, 310, 320. The controller 150 could then be configured to run a number of cycles that is at least equal to but preferably slightly larger (to have safety margin) than this average number of cycles. It is generally expected that the predefined number of cycles required is within the interval of 3 to 5.

In an alternative approach, the controller 150 is configured to control the particle monitor 160 to generate a concentration measure after each cycle of applying an under pressure in a reaction box 300 and applying a gas flow to the reaction box 300. The concentration measure then represents a current concentration of particles in the reaction box 300 following the current cycle. The controller 150 compares the concentration measure with a concentration threshold, preferably stored in the memory 170 or otherwise available to the controller 150. If the current particle concentration in the reaction box 300, as represented by the concentration measure, is equal to or lower than the concentration threshold, sufficient clean room environment has been reached and no further cycle is needed for the reaction box 300. The latest concentration measure generated by the particle monitor 160 can then be used as particle information for the reaction box 300. Alternatively, a new concentration measurement is performed by the particle monitor 160 to get the particle information that is stored in the memory 170 as GMP clean room classification notification for the reaction box 300.

If the concentration measure, however, exceeds the concentration threshold the controller 150 controls the gas multiplexer 130 to perform a new cycle of applying under pressure and applying gas flow to the reaction box 300. The particle monitor 160 then performs a new measurement to generate a new concentration measure that is compared by the controller 150 to the concentration threshold. This procedure is preferably repeated until the concentration measure no longer exceeds the concentration threshold.

In the above described embodiment, the cyclic switching is therefore performed until the current particle concentration in the reaction box 300 has been reduced down to the desired clean room level.

Figure 4:
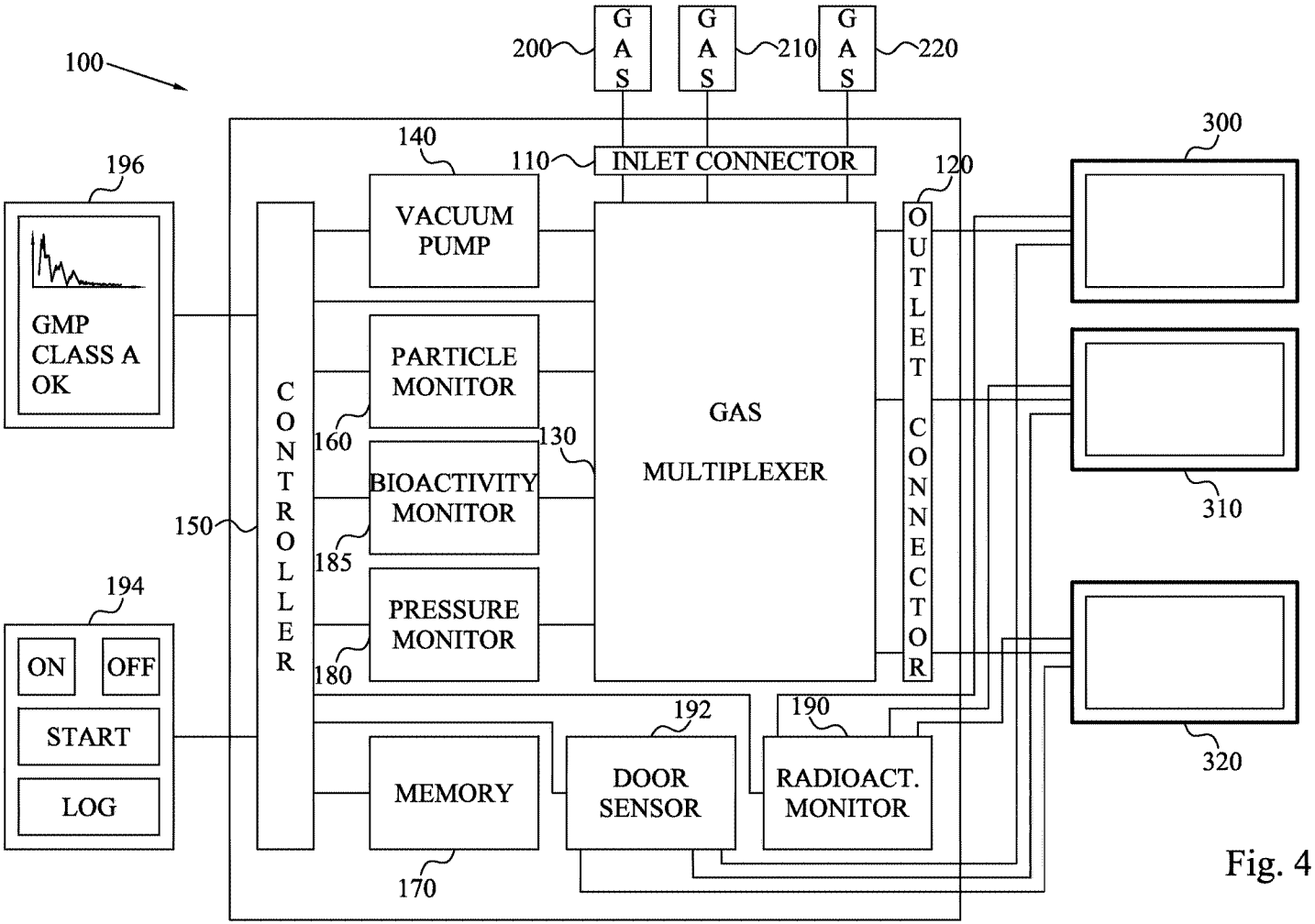
FIG. 4 is a schematic illustration of a system for controlling environment in a reaction box according to yet another embodiment.

In an embodiment, the system 100 comprises or is connected to a notification unit 196 comprising a display or screen and/or a loudspeaker, see FIG. 4. In such a case, the controller 150 is preferably configured to activate the notification unit 196 to display a visible signal and/or generate an audio signal when the current concentration measure generated by the particle monitor 160 is equal to or below the concentration threshold, i.e. when clean room level has been reached. Thus, the user of the system 100 is thereby visually and/or audibly informed that clean room level has been reached in a reaction box 300 and that synthesis can be initiated. A visual signal could be lighting a lamp of the notification unit 196 or switching color of a lamp, such as from red or yellow to green. Alternatively, or in addition, more information could be presented on the display, such as a statement that the desired GMP clean room class is ok. Also the current particle concentration measured by the particle monitor 160 for a reaction box 300 can be displayed on the display as is schematically illustrated in FIG. 4. This information could be graphical information as shown in FIG. 6 and/or concentration values.

In an embodiment, the controller 150 also, or in addition, generates a synthesis trigger signal when the concentration measure is equal to below the concentration threshold and clean room level has been reached for a reaction box 300. The synthesis trigger signal is then preferably transmitted from the controller 150 to the particular reaction box 300. An automatic synthesis of the desired substance can then be started based on the synthesis trigger signal.

Figure 2:
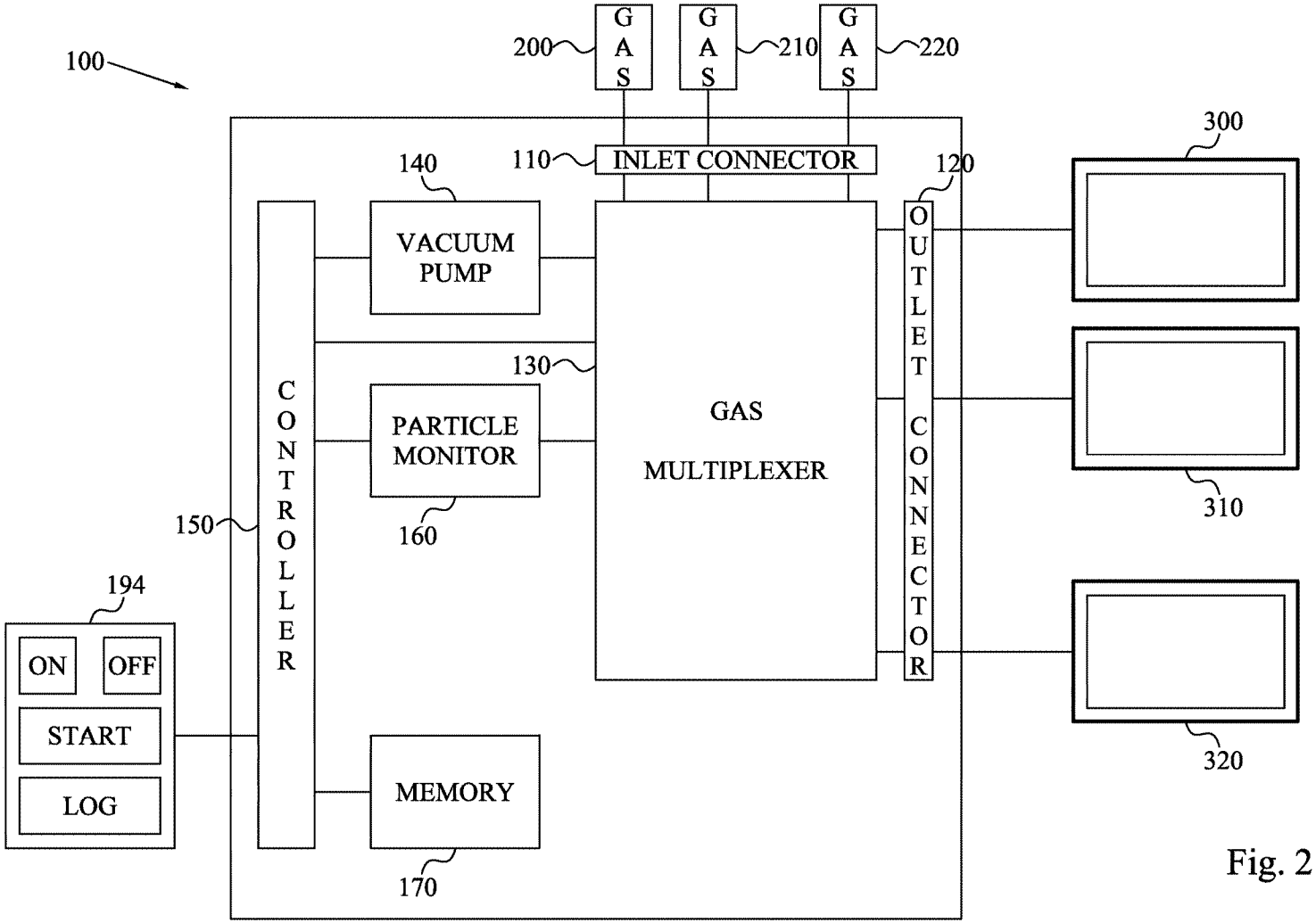
FIG. 2 is a schematic illustration of a system for controlling environment in a reaction box according to another embodiment.

The particular concentration threshold used by the system 100 and the controller 150 has preferably previously been entered by an operator. It could then be possible to use the same concentration threshold for all reaction boxes 300, 310, 320 or different concentration thresholds for different reaction boxes 300, 310, 320 depending on how critical cleanness and particle concentration is for the particular synthesis to be run in a reaction box 300, 310, 320. In a particular embodiment, the system 100 comprises or is connected to a user input 194 as shown in FIGS. 2 and 4. The user input 194 could be in the form of a keyboard or a touch-sensitive screen as illustrative examples. The user could then select, by means of the user input 194, which concentration threshold to use for a particular reaction box 300, 310, 320 prior to starting the process of reaching clean room levels in the reaction box 300, 310, 320.

Different clean room standards exist one of which is presented in Table 1 below.

TABLE 1

| GMP EU classification | | |
|---|---|---|
| | Maximum number of particles/$m^3$ | |
| Class | 0.5 μm | 5 μm |
| A | 3,500 | 0 |
| B | 350,000 | 2,000 |
| C | 3,500,000 | 20,000 |

Other such clean room standards mentioned in the art include ISO 14644-1 clean room standard, BS 5295 clean room standard and US FED STD 209E clean room standard.

An example of a suitable concentration threshold that can be used by the system 100 corresponds to a maximum of 3,500 particles with a size of at least 0.5 μm per cubic meter. This should be compared to ambient air which generally contains about 35,000,000 particles per cubic meter in the size range of 0.5 μm and larger in diameter.

Each reaction box 300, 310, 320 preferably comprises at least one respective door that is movable from a closed state to an open state. In such a case, the particle monitor 160 could also be configured to perform particle concentration measurements of ambient air present around the reaction boxes 300, 310, 320. The controller 150 is preferably configured to control the particle monitor 160 to generate an ambient concentration measure representing the particle concentration present in the ambient air outside of the reaction boxes 300, 310, 320. The controller 150 is further configured to compare the ambient concentration measure with an ambient concentration threshold, which is preferably stored in the memory 170 or otherwise accessible to the controller 150. The controller 150 preferably activates the previously mentioned notification unit 196 (see FIG. 4) if the ambient concentration measure exceeds the ambient concentration threshold. In such a case, the notification unit 196 displays a visible closing signal and/or generates an audio closing signal indicating that the doors of the reaction boxes 300, 310, 320 are preferably not allowed to be moved from the closed state to the open state.

Thus, if there is currently a very high concentration of particles in the air around the reaction boxes 300, 310, 320 the system 100 could warn the user not to open the reaction boxes 300, 310, 320 to thereby prevent the polluted air from entering into the reaction boxes 300, 310, 320. A reason for this is that otherwise the process of anew reaching clean room level inside a reaction box 300, 310, 320, which has been opened, can take some time due to the high concentration of particles entering the reaction box 300, 310, 320. The notification unit 196 thereby provides visual and/or audible information to the user urging him/her to try to reduce the amount of particles in ambient air before opening the reaction boxes 300, 310, 320. The user could for instance activate ventilation in the room where the reaction boxes 300, 310, 320 and the system 100 are present.

The controller 150 preferably controls the particle monitor 160 to, periodically or upon certain activation events, measure the particle concentration in ambient air. Once the particle concentration in ambient air has reduced to lower levels, i.e. equal to or below the ambient concentration threshold, the controller 150 preferably controls the notification unit 196 to stop displaying the visible closing signal and/or generate the audio closing signal. The notification unit 196 could in addition be controlled to display or audibly present a signal indicating to the user that the doors of the reaction boxes 300, 310, 320 can now be opened.

The above mentioned activation events when the particle monitor 160 performs a new concentration measure could be the reception of a user-triggered activation of the user input 194 or the elapse of a certain time period.

In an alternative, or additional, embodiment the doors of the reaction boxes 300, 310, 320 are moved automatically by the system 100. In such a case, the controller 150 generates an opening signal if the ambient concentration measure from the particle monitor 160 is equal to or below the ambient concentration threshold. This opening signal is forwarded from the controller 150 to a selected reaction box 300 in order to open its door. The reaction box 300 preferably comprises a controllable motor or other device that opens the door based on the opening signal. Alternatively, or in addition, the doors of the reaction boxes 300, 310, 320 could be locked when they are in the closed state. In such a case, a locked door is automatically unlocked based on the opening signal. The user can then move the unlocked door from the closed state to the open state.

In a particular embodiment, the system 100 is configured to be operated to reduce the amount of particles that can enter a reaction box 300 when its door is open. This embodiment can be used as a combination to the automatic locking/closing or visual/audio signal discussed in the foregoing. Alternatively, there is no need to monitor the particle concentration in ambient air since this embodiment will effectively prevent a high amount of particles to enter a reaction box 300 even if opened in a polluted environment.

Figure 3:
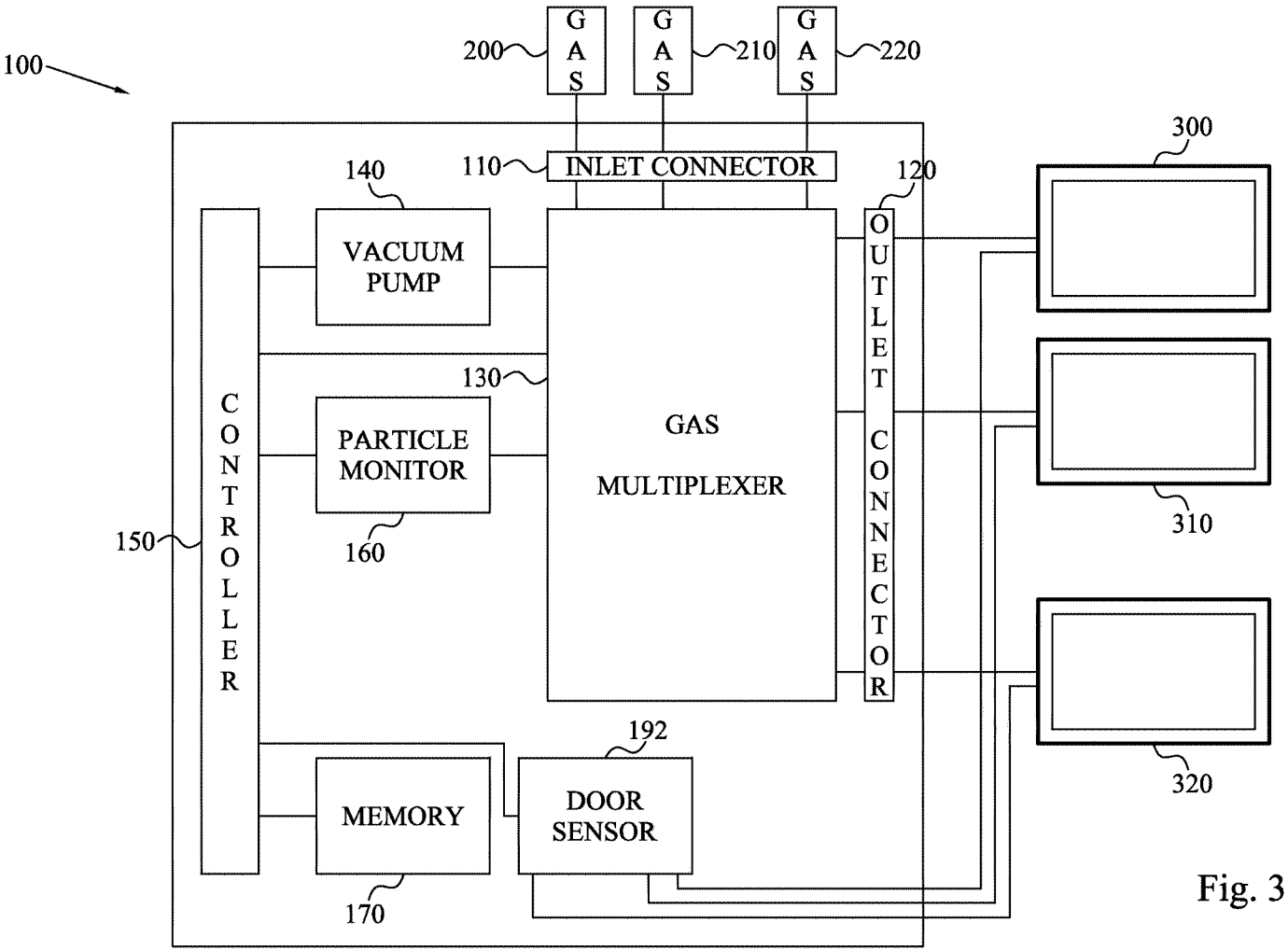
FIG. 3 is a schematic illustration of a system for controlling environment in a reaction box according to a further embodiment.

With reference to FIG. 3, the system 100 preferably comprises a door sensor 192 connected to the reaction boxes 300, 310, 320 and configured to generate an opening signal when the door of a reaction box 300 is moved from the closed state to the open state. The controller 150 is then responsive to this opening signal. In more detail, the controller 150 preferably controls, based on the opening signal, the gas multiplexer 130 to interconnect a gas flow from a gas source 200 and the gas inlet connector 110 to the gas outlet connector 120 and the reaction box 300, the door of which has been opened as detected by the door sensor 192. The interconnection between the gas source 200 and the open reaction box 300 enables a continuous and preferably slow but steady gas flow through the reaction box 300 and out through the open door. This means that when a reaction box 300 is opened the system 100 automatically applies a flow of clean gas through the reaction box 300 to prevent or at least inhibit contamination and particles from entering the reaction box 300 even if open.

The door sensor 192 preferably also generates a closing signal when the door of the reaction box 300 once more is closed. This closing signal could be the same signal as the activation signal that is further discussed here below. The controller 150 is then responsive to this closing signal (or activation signal) to stop the gas flow into the reaction box 300 since the door is once more closed and no more particles can enter the reaction box 300.

In an embodiment as shown in FIG. 2, the system 100 comprises the previously mentioned user input 194. The user input 194 is then configured to generate an activation signal upon activation of the user input 194, such as by pressing one of its key or activating a selected area of a touch sensitive screen. The controller 150 is responsive to this activation signal and controls, based on the activation signal, the gas multiplexer 130 to switch between applying the gas under pressure and applying the gas overpressure in a reaction box 300 in a cyclic manner. Thus, the user of the system 100 employs the user input 194 to select which reaction box 300, 310, 320 that should be cleaned by the system 100 to get the desired clean room environment.

FIG. 3 illustrates an alternative embodiment. In this embodiment the system 100 comprises the previously mentioned door sensor 192 that is connected to each reaction box 300, 310, 320 and configured to generate an activation signal (or closing signal) when the door of a reaction box 300 is moved from the open state to the closed state. This activation signal is then forwarded by the door sensor 192 to the controller 150. The controller 150 thereby controls the gas multiplexer 130 to switch between applying gas under pressure and gas overpressure in a cyclic manner for the reaction box 300 having its door closed as detected by the door sensor 192. Thus, in this embodiment the system 100 automatically cleans a reaction box 300 to reach the desired clean room level once the door of the reaction box 300 is closed.

In an embodiment, the reaction boxes 300, 310, 320 connectable to the system 100, or at least a portion thereof, have a dual-wall system, which is schematically indicated in FIGS. 1-4. Such a reaction box 300 then has an intermediate space between an inner wall enclosure and an outer wall enclosure. The controller 150 could then be configured to control the gas multiplexer 130 to interconnected the intermediate space of a reaction box 300 to the vacuum pump 140 to thereby apply an under pressure in the intermediate space. The gas outlet connector 120 preferably comprises, in this embodiment, a connector terminal that is connectable to this intermediate space. The gas multiplexer 130 interconnects, as controlled by the controller 150, this connector terminal and the vacuum pump 140 to form the under pressure in the intermediate space.

Surrounding the inner wall enclosure of a reaction box 300 with an under pressure provides a safety measure in the case the reaction box 300 contains at least one substance that could be harmful for a user if the substance escapes out of the reaction box 300. Thus, if there is a leakage in the inner wall enclosure any harmful gaseous substances or indeed radioactive substances present in the reaction box 300 will be effectively trapped in the intermediate space and cannot leave the outer wall enclosure. In such a case, the reaction box 300 preferably comprises a waste outlet connected to the intermediate space. This waste outlet is preferably in connection with a waste storage that is either locally arranged together with the reaction boxes 300, 310, 320 but can advantageously be remotely arranged in another part of the building. Any leaking substances will then be drawn by the under pressure into the intermediate space and further out from the waste outlet to enter the waste storage, where they are safely kept out of reach from any user.

Figure 5:
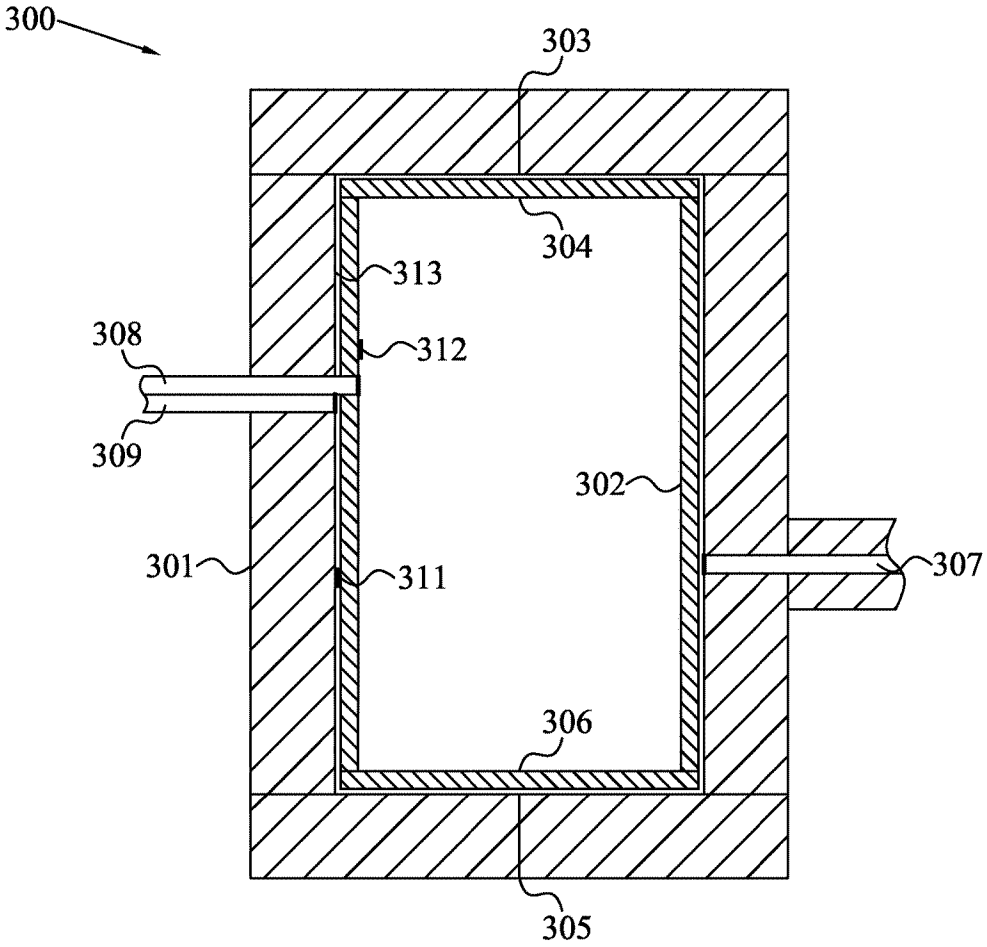
FIG. 5 is a cross-sectional view of a reaction box according to an embodiment.

FIG. 4 illustrates an embodiment of a system 100 with a radioactivity monitor 190. The reaction boxes 300, 310, 320, or at least a portion thereof, are then radiation-shielded reaction boxes 300, 310, 320. The inner wall enclosure 302 and/or preferably the outer wall enclosure 301 of the radiation-shielded reaction box 300 is then preferably designed to block any radioactivity present inside the reaction box 300 as is shown in FIG. 5. Thus, such a radiation-shielded reaction box 300 is designed to be used in connection with synthesis of, for instance, radiotracers and therapeutic radiopharmaceuticals. The outer wall enclosure 301 could then be made of, for instance, concrete or steel having a thickness that is sufficient to prevent any radioactivity from passing through the outer wall enclosure 301.

The radioactivity monitor 190 of the system 100 is preferably configured to generate a radioactivity measure representing a current radioactivity level in the intermediate space 313 between the inner wall enclosure 302 and the outer wall enclosure 301. The controller 150 is connected to the radioactivity monitor 190 and is configured to compare the radioactivity measure generated by the radioactivity monitor 190 with a radioactivity threshold, typically stored in the memory 170 or otherwise accessible to the controller 150. If a current radioactivity level as represented by the radioactivity measure exceeds a safety level as represented by the radioactivity threshold, the controller 150 preferably opens a waste outlet 307 of the radiation-shielded reaction box 300 (see FIG. 5). Thus, any radioactive material escaping through the inner wall enclosure 302 and thereby becoming, due to the under pressure in the intermediate space 313, trapped in the intermediate space 313 will then be drawn through the waste outlet 307 and thereby be transferred to a waste storage, where it is safely kept away from any user. This approach thereby minimizes the risk of any radioactive material from escaping the radiation-shielded reaction box 300 and reaching ambient air.

Any radioactivity monitor 190 available in the art can be used according to the embodiments. Non-limiting examples are market by Carroll/Ramsey Associates.

In an embodiment, the radioactivity monitor 190 is, alternatively or in addition, configured to generate radioactivity information representing a radioactivity level in a radiation-shielded or radiation-shielding reaction box 300. The controller 150 is then configured to control the radioactivity monitor 190 to generate this radioactivity information at least following the end of the cyclic switching between applying the under pressure and applying the overpressure in the radiation-shielded reaction box 300. The generated radioactivity information is stored in the memory 170 as part of the GMP clean room classification notification for the reaction box 300. Thus, the GMP clean room classification notification then not only comprises clean room information with regard to the particle concentration inside the reaction box 300 but also radioactivity information representing the radioactivity level inside the reaction box 300 and optionally also in the intermediate space 313 between the outer and inner wall enclosures 301, 302 of the reaction box 300.

The controller 150 may additionally control the radioactivity monitor 190 to generate a radioactivity measure representing a current radioactivity level in the radiation-shielded reaction box 300. The controller 150 compares this radioactivity measure with a radioactivity threshold and activates the previously mentioned notification unit 196 to display a visible closing signal and/or generate an audio closing signal if the radioactivity measure exceeds the radioactivity threshold. Thus, if the current radioactivity level inside the radiation-shielded reaction box 300 is too high for safely opening a door of the reaction box 300 from a closed state to an open state, the notification unit 196 preferably presents a visible and/or audio alarm (visible closing signal and/or audio closing signal) informing the user of the remaining radioactivity inside the radiation-shielded reaction box 300.

The controller 150 could be configured to control the radioactivity monitor 190 to periodically perform the radioactivity measurements inside the reaction box 300 to generate the radioactivity measure. Alternatively, the controller 150 is responsive to an activation signal generated by the user input 194 when the user presses one of its keys or a selected activation area of the user input 194. The activation signal thereby triggers the controller 150 to activate the radioactivity monitor 190 to perform a new radioactivity measurement as disclosed above.

In an alternative or additional embodiment, the door of the radiation-shielded reaction box 300 is automatically opened, i.e. moved from the closed state to the open state, in response to an opening signal from the controller 150. The controller 150 preferably generates the opening signal if the radioactivity measure generated by the radioactivity monitor 190 is equal to or below the radioactivity threshold. Thus, in such a case the controller 150 can safely open the door to the radiation-shielded reaction box 300 since there is no radioactivity left therein or any remaining radioactivity is at safely low levels.

The controller 150 can additionally be configured to control the radioactivity monitor 190 to generate an ambient radioactivity measure representing an ambient radioactivity level in ambient air outside of the radiation-shielded reaction boxes 300, 310, 320. The controller 150 compares this ambient radioactivity measure with an ambient radioactivity threshold and activates the notification unit 196 if the ambient radioactivity measure exceeds the ambient radioactivity threshold. The notification unit 196 is thereby caused to display a visible alarm signal and/or generate an audio alarm signal that informs the user of radioactivity present in the facility with the reaction boxes 300, 310, 320.

In similar to the previously described particle monitor 160 and the radioactivity monitor 190, the system 100 can also comprise a bioactivity monitor 185 connectable to a reaction box 300, 310, 320 and configured to generate bioactivity information representing presence of any microorganisms inside the reaction box 300, 310, 320. The controller 150 is then configured to control the bioactivity monitor 185 to generate bioactivity information indicative of presence of microorganisms in the reaction box 300 at least following the end of the cyclic switching between applying the under pressure and the overpressure in the reaction box 300. The generated bioactivity information is stored in the memory 170 as part of the GMP clean room classification notification for the reaction box 300. Thus, in this embodiment the GMP clean room classification notification not only comprises the particle information but also the bioactivity information and preferably also the radioactivity information. Hence, a more complete set of the conditions inside a reaction box 300 is thereby obtained and can be used to verify that the environment inside the reaction box 300 was correct at the time of starting a synthesis therein.

In a particular embodiment and as previously discussed herein, the interior of a reaction box 300 is preferably kept at an overpressure, whereas any intermediate space between the inner and outer wall enclosures of the reaction box 300 is preferably kept at an under pressure. In such a case, the system 100 can comprise a pressure monitor 180 that is controlled by the controller 150 to generate a pressure measure representing a current pressure level in the reaction box 300. There are several pressure monitors and sensors available on the market and that can be used according to the embodiments. For instance, Gems™ Sensors & Controls have pressure sensors that can be used by the embodiments.

The controller 150 is configured to compare the pressure measure with at least one pressure threshold, preferably two such pressure thresholds. In such a case, a first or lower pressure threshold could represent the lower end of a suitable pressure interval for the reaction box 300 with a second or higher pressure threshold representing the upper end of the pressure interval. If the current pressure inside the reaction box 300 is within the pressure interval, a correct overpressure is present in the reaction box 300. However, if the pressure measure is below the first pressure threshold, the controller 150 preferably controls the gas multiplexer 130 to interconnect the gas inlet connector 110 and thereby a gas source 200 to the gas outlet connector 120 and the reaction box 300 to provide a gas flow into the reaction box 300 to thereby increase the pressure inside the reaction box 300. Correspondingly, if the pressure measure exceeds the second pressure threshold, the controller 150 preferably controls the gas multiplexer 130 to interconnect the vacuum pump 140 to the gas outlet connector 120 and the reaction box 300 to vent gas from the reaction box 300 to thereby reduce the pressure inside the reaction box 300. Thus, in this embodiment the controller 150 is configured to control the gas multiplexer 130 to interconnect one of the gas inlet connector 110 and the vacuum pump 140 to the gas outlet connector 120 to apply one of a gas overpressure and an under pressure to the reaction box 300 based on a comparison of the pressure measure and at least one pressure threshold.

FIG. 5 is a cross-sectional view of a reaction box 300 according to an embodiment. The reaction box 300 has been exemplified to have a dual-wall system with an intermediate space 313 between an inner wall enclosure 302 and an outer wall enclosure 301. The inner wall enclosure 302 comprises one or more doors 304, 306 with one or more matching doors 303, 305 of the outer wall enclosure 301 to thereby get access to the interior of the reaction box 300.

The reaction box 300 can be a radiation-shielded reaction box 300 as previously discussed herein. In such a case, at least one of the inner wall enclosure 302 and the outer wall enclosure 301, preferably the outer wall enclosure 301, constitutes a radiation shield to thereby prevent any radiation present inside the reaction box 300 from passing through the outer wall enclosure 301.

The figure also illustrates the previously discussed waste outlet 307 that preferably interconnects the intermediate space 313 with a remote waste storage (not illustrate).

Single or multi-way gas connections 308, 309 interconnect the interior of the reaction box 300 and preferably the intermediate space 313 with the gas outlet connector 120 of the system 100 and optionally the radioactivity monitor 190. Reference numbers 311, 312 represent pressure sensors 311, 312 present in the reaction box 300 and in the intermediate space 313, which could be connected to the pressure monitor 180.

The reaction boxes 300, 310, 320 connected to the system 100 can be arranged as separate devices. Alternatively, a reaction box 300 could have its separate inner wall enclosure 302 but then share a common outer wall enclosure, such as a radiation-shielded outer wall enclosure with at least one other reaction box.

The reaction boxes 300 are designed to enclose a controlled environment in which a synthesis of a desired substance, such as radiotracer or radiopharmaceutical, is to take place. The synthesis inside the reaction box 300 is preferably taking place in one or more synthesis chips or microfluidic cassettes. Such microfluidic cassettes are well known in the art and disclosed, for instance, in U.S. Pat. No. 7,829,032 and US 2011/0008215.

Such microfluidic cassettes can be manufactured at very small sizes, such as having largest dimensions of one or few centimeters. Hence, the interior volume of the reaction box 300 can be kept very small, for instance, from part of a liter up to one or few tens of liters. For instance, an internal size of 10 cm×20 cm×30 cm (width×height×length) gives a total internal volume of 6 L and can efficiently house one or more microfluidic cassette. The outer dimensions of a reaction box 300 can also be kept very small even when using radiation-shielding material in the outer wall enclosure 301. Thus, the outer dimensions of a reaction box 300 can generally be in the order of one or more tens of centimeters. For instance, an external size of a reaction box could be 20 cm×30 cm×40 cm (width×height×length).

Any radioactivity that is to be used in the synthesis can be produced by an in-site or remotely arranged generator or cyclotron connected to the reaction boxes 300, 310, 320.

The small size of the reaction boxes 300, 310, 320 implies that the complete reaction box 300, 310, 320 could be sterilized prior to starting a synthesis reaction and prior to connecting the reaction box 300, 310, 320 to the system 100. For instance, the reaction box 300, 310, 320 could be autoclaved.

The very small size of the reaction boxes 300, 310, 320 and the system 100 implies that the system 100 with connected reaction box(es) 300, 310, 320 can be efficiently arranged in a healthcare facility and even in the relevant diagnostic (SPECT/PET) or treatment room.

The small size of the system 100 and the reaction boxes 300, 310, 320 and the possibility of conducting the synthesis close to or even in the same room as the diagnosis or therapy, implies that radionucleotides with short half-lives can be used since the produced radiotracer or radiopharmaceutical can be administered to the patient directly following synthesis without any long and time-consuming transports of the radiotracer/radiopharmaceutical from a remote hot laboratory.

The small overall size also means that the total cost of the system 100 and the reaction boxes 300, 310, 320 is vastly lower as compared to the total cost for a complete hot laboratory. The system 100 will therefore lead to a more flexible usage of radiotracers and radiopharmaceutical, among others, that do not need to be limited to healthcare facilities situated in connection with hot laboratories.

The system 100 of the embodiments is easily operated and does not require qualified synthesis personal to be run. Hence, the system 100 can be used also by medical personnel in healthcare facilities lacking any expertise in radiotracer/radiopharmaceutical synthesis.

A further advantage is that a single system 100 can be connected to and configured to control the environment in multiple reaction boxes 300, 310, 320 to enable production, even parallel production, of different radiotracers and/or radiopharmaceuticals or other substances in the different reaction boxes 300, 310, 320. Thus, it is possible to form and maintain different individual environments in the reaction boxes 300, 310, 320 that are adapted to the particular synthesis conditions taking place in the given reaction box 300, 310, 320.

A further significant advantage of the embodiments is that a current GMP qualification is obtained at each synthesis in a reaction box 300, 310, 320. The GMP clean room classification notification thereby provides relevant verification data defining the actual conditions in the reaction box 300, 310, 320 at the time of synthesis. This is not possible within hot laboratories where GMP verifications are done at scheduled points in time and not in connection with actual synthesis.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

The invention claimed is:

1. A system for controlling environment in a reaction box comprising:

a gas inlet connector connectable to at least one gas source comprising a respective gas;

a gas outlet connector connectable to at least one reaction box;

a gas multiplexer connected to said gas inlet connector and said gas outlet connector and configured to interconnect a gas flow from said gas inlet connector to said gas outlet connector to supply gas from the at least one gas source to the at least one reaction box;

a vacuum pump connected to said gas multiplexer, wherein the gas multiplexer is configured to interconnect the vacuum pump and the gas outlet connector to generate an under pressure inside the at least one reaction box;

a controller configured to control said gas multiplexer to switch between interconnecting the vacuum pump and the gas outlet connector to apply an under pressure in the at least one reaction box and interconnecting the gas inlet connector and the gas outlet connector to apply a gas flow from the at least one gas source to the at least one reaction box multiple times in a cyclic manner to reduce an amount of particles present in the at least one reaction box;

a particle monitor connectable to the at least one reaction box and configured to generate particle information representing a concentration of particles present in the at least one reaction box, wherein said controller is configured to control said particle monitor to generate said particle information representing said concentration of said particles in the at least one reaction box following an end of the cyclic switching between applying said under pressure and applying said gas flow; and a memory configured to store said particle information generated by said particle monitor as a good manufacturing practice, GMP, clean room classification notification for said reaction box.

2. The system according to claim 1, wherein said controller is configured to control said gas multiplexer to switch between applying said under pressure in said reaction box and applying a gas overpressure from said gas source to said reaction box multiple times in a cyclic manner.

3. The system according to claim 1, wherein said particle monitor is connected to said gas multiplexer, and said controller is configured to control said gas multiplexer to interconnect said particle monitor to said gas outlet connector connectable to said reaction box to enable said particle monitor to generate said particle information.

4. The system according to claim 1, wherein said controller is configured to control said gas multiplexer to switch between applying said under pressure in said reaction box and applying said gas flow to said reaction box 3 to 5 times in a cyclic manner.

5. The system according to claim 1, wherein said controller is configured to i) control said particle monitor to generate a concentration measure of a current concentration of said particles in said reaction box following each cycle of applying said under pressure in said reaction box and applying said gas flow to said reaction box, ii) compare said concentration measure with a concentration threshold, and iii) control said gas multiplexer to switch between applying said under pressure in said reaction box and applying said gas flow to said reaction box for a new cycle if said concentration measure exceeds said concentration threshold.

6. The system according to claim 5, further comprising a notification unit configured to display a visible signal and/or generate an audio signal, wherein said controller is configured to activate said notification unit to display said visible signal and/or generate said audio signal if said concentration measure is equal to or below said concentration threshold.

7. The system according to claim 5, wherein said controller is configured to generate a synthesis trigger signal if said concentration measure is equal to or below said concentration threshold and transmit said synthesis trigger signal to said reaction box.

8. The system according to claim 5, wherein said concentration threshold is 3,500 particles with a size of at least 0.5 μm per cubic meter.

9. The system according to claim 1, further comprising a user input configured to generate an activation signal upon activation of said user input, wherein said controller is configured to control, in response to said activation signal, said gas multiplexer to switch between applying said under pressure in said reaction box and applying said gas flow to said reaction box multiple times in a cyclic manner.

10. The system according to claim 1, further comprising a bioactivity monitor connectable to said at least one reaction box and configured to generate bioactivity information representing presence of microorganisms in said at least one reaction box, wherein said controller is configured to control said bioactivity monitor to generate said bioactivity information representing presence of microorganisms in said reaction box following said end of said cyclic switching between applying said under pressure and applying said gas flow; and said memory is configured to store said bioactivity information generated by said bioactivity monitor as part of said GMP clean room classification notification.

11. The system according to claim 1, further comprising a pressure monitor connectable to said reaction box and configured to generate a pressure measure representing a pressure level in said reaction box, wherein said controller is configured to control said gas multiplexer to interconnect one of said gas inlet connector and said vacuum pump to said gas outlet connector to apply one of a gas overpressure and an under pressure to said reaction box based on a comparison of said pressure measure and at least one pressure threshold.

12. A system for controlling environment in a reaction box comprising:

a reaction box;

a gas inlet connector connectable to at least one gas source comprising a respective gas;

a gas outlet connector connected to said reaction box;

a gas multiplexer connected to said gas inlet connector and said gas outlet connector and configured to interconnect a gas flow from said gas inlet connector to said gas outlet connector to supply gas from the at least one gas source to said reaction box;

a vacuum pump connected to said gas multiplexer, wherein the gas multiplexer is configured to interconnect the vacuum pump and the gas outlet connector to generate an under pressure inside said reaction box;

a controller configured to control said gas multiplexer to switch between interconnecting the vacuum pump and the gas outlet connector to apply an under pressure in said reaction box and interconnecting the gas inlet connector and the gas outlet connector to apply a gas flow from the at least one gas source to said reaction box multiple times in a cyclic manner to reduce an amount of particles present in said reaction box;

a particle monitor connectable to said reaction box and configured to generate particle information representing a concentration of particles present in said reaction box, wherein said controller is configured to control said particle monitor to generate said particle information representing said concentration of said particles in said reaction box following an end of the cyclic switching between applying said under pressure and applying said gas flow; and a memory configured to store said particle information generated by said particle monitor as a good manufacturing practice, GMP, clean room classification notification for said reaction box.

13. The system according to claim 12, wherein said reaction box comprises a door movable from a closed state to an open state, said system further comprises a notification unit configured to display a visible closing signal and/or generate an audio closing signal indicating that said door is not allowed to be moved from said closed state to said open state, wherein said controller is configured to i) control said particle monitor to generate an ambient concentration measure representing a concentration of particles present in ambient air outside of said at least one reaction box, ii) compare said ambient concentration measure with an ambient concentration threshold, and iii) activate said notification unit to display said visible closing signal and/or generate said audio closing signal if said ambient concentration measure exceeds said ambient concentration threshold.

14. The system according to claim 12, wherein said reaction box comprises a door movable from a closed state to an open state in response to an opening signal, and said controller is configured to i) control said particle monitor to generate an ambient concentration measure representing a concentration of particles present in ambient air outside of said at least one reaction box, ii) compare said ambient concentration measure with an ambient concentration threshold, and iii) generate said opening signal if said ambient concentration measure is equal to or below said ambient concentration threshold.

15. The system according to claim 12, wherein said reaction box comprises a door movable from an open state to a closed state, said system further comprises a door sensor configured to generate an activation signal when said door is moved from said open state to said closed state, wherein said controller is configured to control, in response to said activation signal, said gas multiplexer to switch between applying said under pressure in said reaction box and applying said gas flow to said reaction box multiple times in a cyclic manner.

16. The system according to claim 12, wherein said reaction box comprises a door movable from a closed state to an open state, said system further comprises a door sensor configured to generate an opening signal when said door is moved from said closed state to said open state, wherein said controller is configured to control, in response to said opening signal, said gas multiplexer to interconnect a gas flow from said gas inlet connector to said gas outlet connector to apply a continuous gas flow through said reaction box when said door is in said open state.

17. The system according to claim 12, wherein said reaction box has a dual-wall system with an intermediate space between an inner wall enclosure and an outer wall enclosure, said controller is configured to control said gas multiplexer to interconnect said vacuum pump and said gas outlet connector to apply an under pressure in said intermediate space.

18. The system according to claim 17, wherein said reaction box is a radiation-shielded reaction box, said system further comprises a radioactivity monitor configured to generate a radioactivity measure representing a current radioactivity level in said intermediate space, wherein said controller is configured to i) compare said radioactivity measure with a radioactivity threshold and ii) open a waste outlet connected to said intermediate space if said radioactivity measure exceeds said radioactivity threshold.

19. The system according to claim 12, wherein said at least one reaction box is at least one radiation-shielded reaction box and said system further comprises a radioactivity monitor connectable to said at least one radiation-shielded reaction box and configured to generate radioactivity information representing a radioactivity level in said at least one radiation-shielded reaction box, wherein said controller is configured to control said radioactivity monitor to generate said radioactivity information representing said radioactivity level in said radiation-shielded reaction box following said end of said cyclic switching between applying said under pressure and applying said gas flow; and said memory is configured to store said radioactivity information generated by said radioactivity monitor as part of said GMP clean room classification notification.

20. The system according to claim 19, wherein said radiation-shielded reaction box comprises a door movable from a closed state to an open state, said system further comprises a notification unit configured to display a visible closing signal and/or generate an audio closing signal indicating that said door is not allowed to be moved from said closed state to said open state, wherein said controller is configured to i) control said radioactivity monitor to generate a radioactivity measure representing a current radioactivity level in said radiation-shielded reaction box, ii) compare said radioactivity measure with a radioactivity threshold, and iii) activate said notification unit to display said visible closing signal and/or generate said audio closing signal if said radioactivity measure exceeds said radioactivity threshold.

21. The system according to claim 19, wherein said radiation-shielded reaction box comprises a door movable from a closed state to an open state in response to an opening signal, and said controller is configured to i) control said radioactivity monitor to generate a radioactivity measure representing a current radioactivity level in said radiation-shielded reaction box, ii) compare said radioactivity measure with a radioactivity threshold, and iii) generate said opening signal if said radioactivity measure is equal to or below said radioactivity threshold.

22. The system according to claim 19, further comprising a notification unit configured to display a visible alarm signal and/or generate an audio alarm signal, wherein said controller is configured to i) control said radioactivity monitor to generate an ambient radioactivity measure representing an ambient radioactivity level in ambient air outside of said at least one radiation-shielded reaction box, ii) compare said radioactivity measure with an ambient radioactivity threshold, and iii) activate said notification unit to display said visible alarm signal and/or generate said audio alarm signal if said ambient radioactivity measure exceeds said ambient radioactivity threshold.

* * * * *